United States Patent [19]

Foster et al.

[11] Patent Number: 4,848,595

[45] Date of Patent: Jul. 18, 1989

[54] PRODUCT DISPENSER WITH SHIFTABLE CLOSURE BLADE

[75] Inventors: Donald D. Foster, Lee's Summit; Philip L. Nelson, Kansas City, both of Mo.

[73] Assignee: Realex Corporation, Lee's Summit, Mo.

[21] Appl. No.: 198,557

[22] Filed: May 23, 1988

[51] Int. Cl.[4] ..... B67B 5/00

[52] U.S. Cl. ..... 222/153; 222/402.11; 222/559

[58] Field of Search ..... 222/153, 207, 384, 383, 222/386, 402.1, 402.11, 542, 544, 559

[56] References Cited

U.S. PATENT DOCUMENTS

| | | | |
|---|---|---|---|
| Re. 31,408 | 10/1983 | Czech et al. | 222/341 |
| 2,532,690 | 12/1950 | Zimmerman | 222/92 |
| 2,772,819 | 12/1956 | Poarch et al. | 222/374 |
| 2,927,717 | 3/1960 | McDermott | 222/213 |
| 3,386,631 | 6/1968 | Kotuby | 222/402.11 |
| 3,429,483 | 2/1969 | Micallef | 222/153 |
| 3,734,353 | 5/1973 | McIlhenny | 222/153 |
| 3,967,760 | 7/1976 | Marcon | 222/153 |
| 4,343,417 | 8/1982 | Corsette | 222/153 |
| 4,679,712 | 7/1987 | Foster et al. | 222/384 |

*Primary Examiner*—Joseph J. Rolla
*Assistant Examiner*—Kenneth Noland
*Attorney, Agent, or Firm*—Hovey, Williams, Timmons & Collins

[57] ABSTRACT

A relatively small product dispenser for cosmetics such as creams and lotions and adapted to be carried in a handbag or purse has a locking ring which is rotatable to a first orientation that prevents depression of an actuator and which is also rotatable a second orientation enabling actuator movement. The locking ring is coupled to a closure element in such a fashion that the element covers a discharge opening of the dispenser when the actuator is locked in position in order to retard the drying and consequent hardening of any products remaining within a passageway adjacent the discharge opening. As the locking ring is turned to its second orientation enabling the actuator to be depressed, the closure element moves away from the discharge opening to permit full flow of products therethrough.

10 Claims, 2 Drawing Sheets

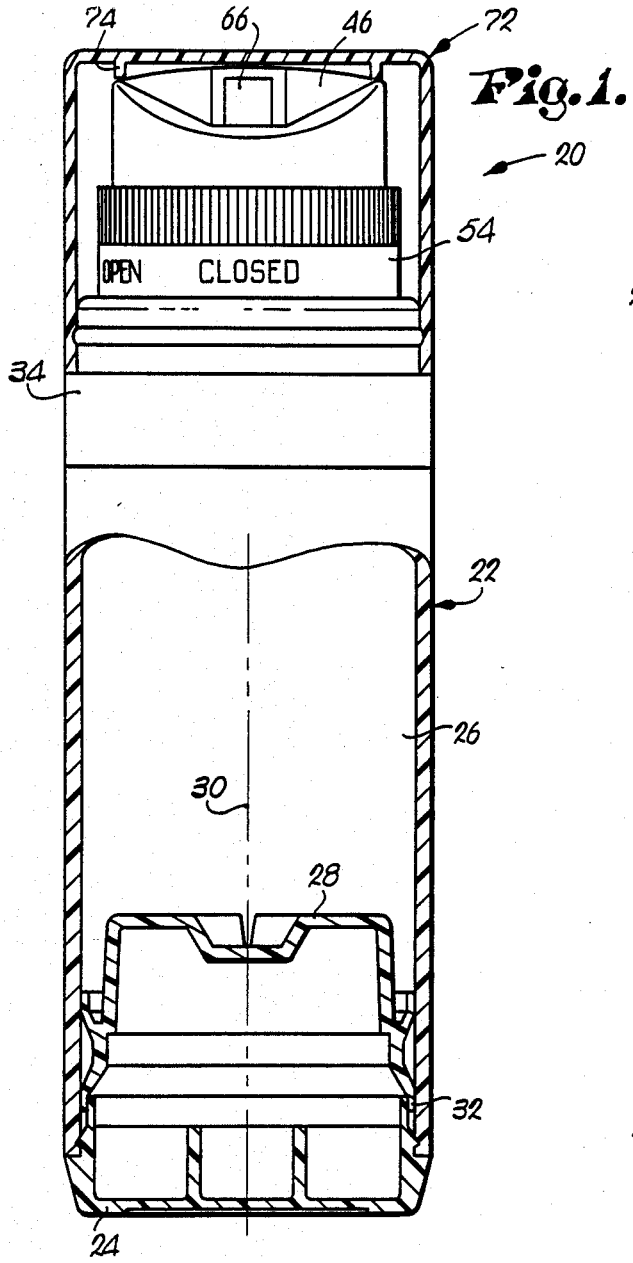
Fig. 1.
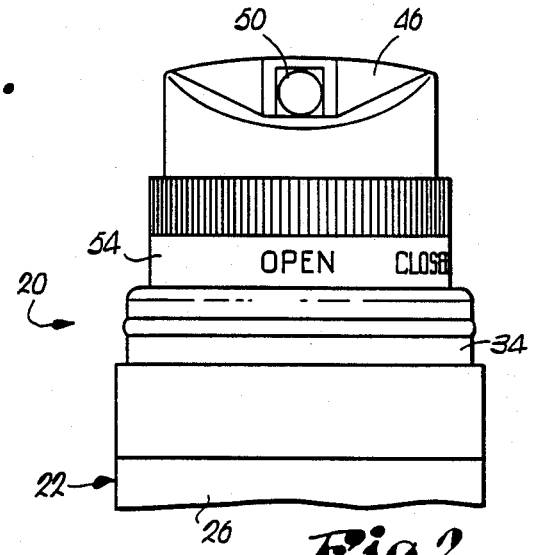
Fig. 2.
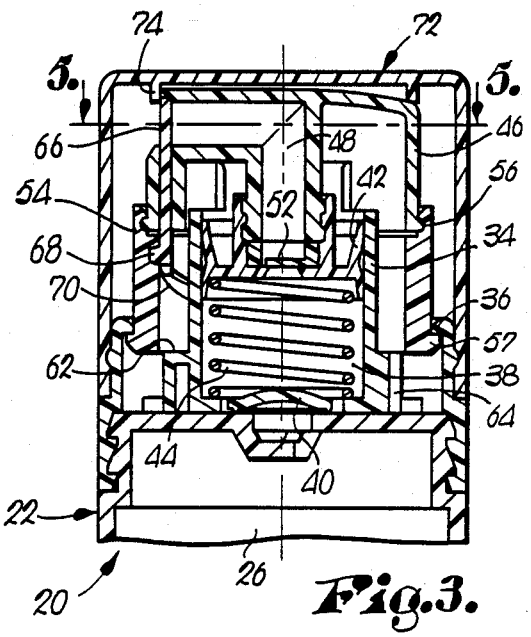
Fig. 3.
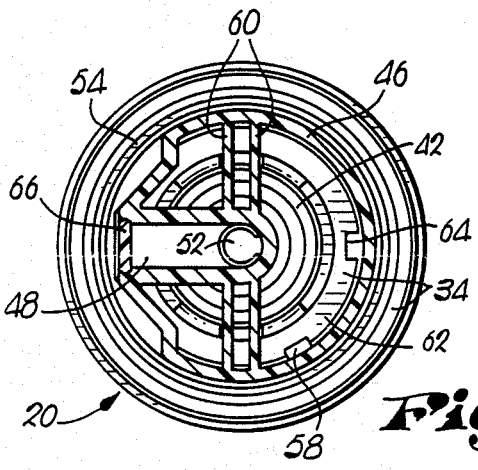
Fig. 5.
Fig. 4.
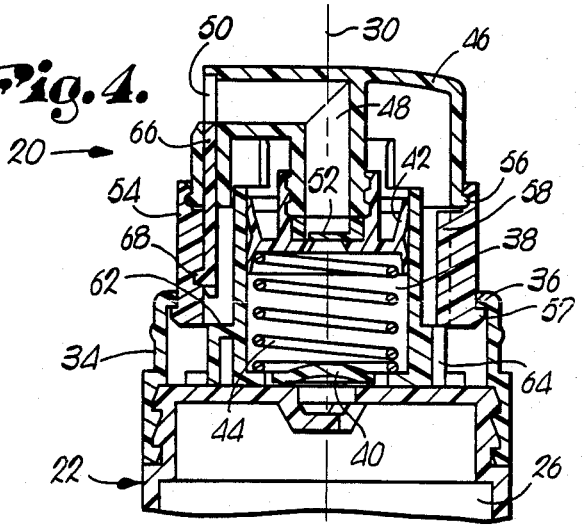

PRODUCT DISPENSER WITH SHIFTABLE CLOSURE BLADE

BACKGROUND OF THE INVENTION

1. Field of the Invention

This invention broadly relates to a pump dispenser for lotions, creams and the like, and particularly concerns a product dispenser having a locking ring which is rotatable to prevent depression of an actuator and effect closing of a product discharge opening.

2. Description of Prior Art

Certain pump dispensers for semi-viscous materials such as creams and lotions are constructed with a depressable actuator having internal structure defining a product flow passageway. The actuator is connected to a piston and depression of the actuator shifts the piston to eject the products through the passageway and toward a spout or discharge opening formed in the actuator.

Smaller pump dispensers which are of dimensions that can readily fit within the confines of a purse, handbag, or cosmetic bag have become increasingly popular in recent years. However, it is apparent that accidental discharge or leakage of the contents from the dispenser is to be avoided at all costs when the dispensers are carried about in this manner. As one example, shifting of other heavy articles within the purse or bag or movement of the walls of the purse or bag under the influence of external forces may in some cases depress the pump actuator a sufficient distance to cause product discharge within the bag.

Another problem that has long been associated with conventional pump dispensers is the tendency for materials remaining in the passageway adjacent the discharge opening to dry, harden and possibly form a crust. The dry, caked materials may substantially impede the flow of additional materials during subsequent attempts to operate the dispenser. Moreover, somewhat hardened globules of dried material may become entrained with dispensed portions of fresh material having a creamier texture, thereby creating an unattractive mixture which is undesirable for obvious reasons.

A dispensing pump having a locking cover which is slidable to close a spout discharge opening and prevent depression of an actuator button is describe and illustrated in U.S. Pat. No. 4,679,712 dated July 14, 1987 and assigned to the assignee of the present invention. While the slidable cover of the pump disclosed in U.S. Pat. No. 4,679,712 has been found to provide reliable and satisfactory performance when used with large dispensers, the finger actuated slidable cover would be difficult to maneuver if the entire dispenser were hypothetically reduced in scale to readily fit within the confines of a smaller purse or handbag.

In this regard, there is oftentimes a natural reluctance among certain consumers to carry in a purse, cosmetic case or handbag dispensers that contain semi-viscous creams and the like for fear of leakage. Thus, it would also be desirable to provide a smaller dispensing pump with a locking member which is located away from the actuator surfaces engaged during the dispensing operation and therefore provides additional psychological assurances in the form of positive feedback to the user that accidental depression of the actuator cannot occur.

SUMMARY OF THE INVENTION

The present invention represents a significant advance in the art by provision of a pump dispenser having an annular locking member or ring that is disposed below the top of the actuator and that is rotatable relative to the actuator in one direction to an orientation which precludes depression of an actuator and also which causes a product discharge opening formed within the actuator to be closed. Rotation of the locking ring in an opposite direction to a second orientation enables the actuator to be subsequently depressed, and also causes the discharge opening to be uncovered to permit full flow of products therethrough.

The locking ring, being disposed below the top, finger engageable surfaces of the button, is hence normally grasped and turned to prevent unintentional actuator depression only after the user has changed his or her grip on the dispenser housing subsequent to the dispensing operation. As a consequence, the locking ring provides a comforting psychological assurance to the user that the dispenser is securely closed and locked and therefore can be safely carried in a purse or case amidst other contents. Moreover, inasmuch as the locking ring surrounds the dispenser, the ring is of a size which can be easily grasped by the user even though the overall diameter of the pump housing may be relatively small such as, for example, approximately 1.2 inch.

In accordance with the invention, the locking member is connected to a shiftable blade or closure element which is movable toward a position blocking the discharge opening when the ring is turned to prevent depression of the actuator. In one embodiment of the invention, the closure element has a portion which rides within a helical-shaped groove formed within the locking ring, and rotation of the ring about its central axis causes the closure element to move in directions parallel to such axis. In another embodiment of the invention, the closure element is integrally formed as a portion of the locking ring and thereby moves to cover or uncover the discharge opening during rotation of the locking ring.

In one embodiment, the closure blade is shiftable along a path that extends within a cavity formed in the depressable actuator when the closure element is moved away from the discharge opening. As such, the blade is substantially hidden from view when retracted. Once the blade is moved in an opposite direction to close the opening and a cap is installed over the actuator, an interior wall depending from the top of the cap comes into contact with an upper portion of the blade and functions to ensure that the blade does not move in a laterally outward direction if large amounts of compressive forces are exerted on the dispenser housing.

BRIEF DESCRIPTION OF THE DRAWINGS

FIG. 1 Is a side elevational view of one preferred embodiment of a product dispenser constructed in accordance with the principles of the present invention, with portions cut away in section to reveal a product storage reservoir and lower piston;

FIG. 2 is a fragmentary, side elevational view of an upper portion of the dispenser illustrated in FIG. 1 with the cap removed, and with a locking ring or member of the dispenser pivoted toward an orientation to cause a shiftable closure blade to move away from a product discharge opening;

FIG. 3 is a fragmentary, side cross-sectional view of the dispenser shown in FIG. 1 with the closure blade in the closed position;

FIG. 4 is a view somewhat similar to FIG. 3, except that the cap has been removed and the closure blade has been shifted toward the position shown in FIG. 2 for opening the discharge opening;

FIG. 5 is a horizontal sectional view taken along line 5—5 of FIG. 3 with the cap removed;

DETAILED DESCRIPTION OF THE DRAWINGS

Figure 7:
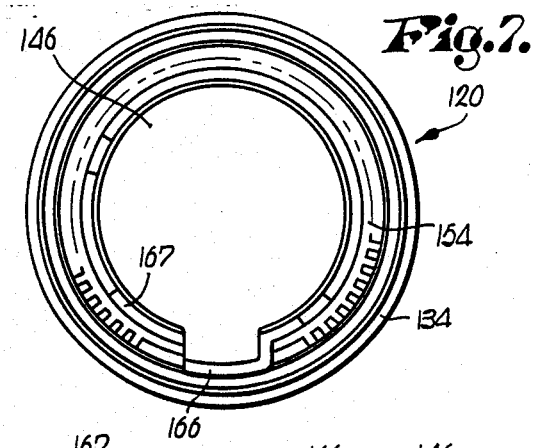
FIG. 7 is a plan view of the dispenser shown in FIG. 6 with a cap removed.

Referring initially to the embodiment described in FIGS. 1-5, a pump dispenser 20 especially adapted for dispensing lotions, creams and the like has a somewhat cylindrical, tubular housing 22 terminating at its lower end in a base 24 (FIG. 1). The interior walls of housing 22 define a product storage reservoir 26, and a lower piston 28 received in the reservoir 26 is movable along an axis 30.

A lower flange 32 of the piston 28 extends into an annular space between an upper portion of the base 24 and adjacent regions of the housing 22 when the piston 28 is in the position shown in FIG. 1. The flange 32 fits in tongue and groove relationship into the annular space to substantially prevent any likelihood of leakage past the piston 28 before the dispenser is put in use and the lower piston 28 begins its upward movement.

A body 34 is assembled in snap-fit reception with a ribbed, upper portion of the housing 22 as shown in FIGS. 3 and 4. The body 34 has an outer, somewhat cylindrical wall portion topped by an inwardly extending flange 36, and also has an interior, somewhat cylindrical portion which defines a product holding chamber 38. A lower, flap-like segment 40 of the body 34 functions as a check valve as will be explained in further detail below and the segment 40 is inherently biased toward a position closing a passage interconnecting the product storage reservoir 26 and the product holding chamber 38.

An upper piston 42 is reciprocably movable in the chamber 38 and is normally biased upwardly and away from the segment 40 by means of a helical compression spring 44. An upper region of the piston 42 is snapped onto a lower depending segment of a depressable head or actuator 46 which includes internal structure defining a product flow passageway 48 that terminates in a discharge opening 50 (FIGS. 2 and 4). A check valve 52, locked in place between the actuator 46 and the piston 42, is inherently resilient and is normally biased toward a position closing an opening formed within the piston 42 for communicating the product holding chamber 38 with the product flow passageway 48.

An annular locking member or ring 54 has an upper, circular, inner groove which receives an outwardly facing, circular rib 56 that is formed in a lower, outer wall of the actuator 46. A lower region of the locking ring 54 has an outwardly turned flange 57, and the flange 36 of body 34 engages flange 57 when in the position shown in FIGS. 3 and 4 for preventing further upward movement of the ring 54 relative to body 34.

The locking ring 54 is shiftably coupled to the body 34 for rotatable movement about axis 30 from a first orientation that is shown in FIGS. 1, 3, and 5 and a second orientation which is illustrated in FIGS. 2 and 4. During rotation of ring 54, the latter moves relative to the body 34 and also relative to actuator 46. As shown in FIG. 5, two pairs of upper, vertically extending walls 60 are received in slots formed in upper, inner regions of the body 34 to prevent rotation of the acutator 46 relative to body 34 during turning motion of the locking ring 54.

The locking ring 54 has a vertical, elongated rib 58 which is illustrated in FIG. 5 and which also is indicated by the dashed lines in FIG. 4. When the ring 54 is in the first orientation as shown in FIGS. 1, 3 and 5, the lower end of rib 58 comes into contact with an upper surface of a shoulder 62 formed in the body 34 to prevent depression of the ring 54 and corresponding downward movement of the actuator 46. However, when the locking ring 54 is turned to its second orientation as shown in FIGS. 2 and 4, rib 58 is aligned with a slot 64 (FIGS. 4 and 5) which provides sufficient clearance for receiving the rib 54 and enabling downward movement of the ring 54 along with actuator 46.

A blade-like closure element 66 is shiftably coupled to the ring 54 for movement in a direction parallel to axis 30 during rotation of the locking ring 54. As shown in FIGS. 3 and 4, a lower portion of the closure element 66 is formed with an outwardly extending rib section 68 that is received in a somewhat helically-shaped groove 70 (FIG. 3) that is formed in an inner, cylindrical wall of the locking ring 54. The closure element 66 is movable between a first or upward position that is illustrated in FIGS. 1 and 3 for substantially closing the discharge opening 50 when the locking ring 54 is in its first orientation. During rotation of the ring 54 in an opposite direction toward its second orientation, the walls of the groove 70 urge the rib section 68 in a downwardly direction to thereby shift the closure element 66 vertically toward a second position substantially uncovering the discharge opening 50 as shown in FIGS. 2 and 4.

OPERATION OF THE EMBODIMENT SHOWN IN FIGS. 1-5

When the ring 54 is in its first orientation such that the words "closed" (FIG. 1) formed beneath a serrated perphery of ring 54 are in vertical alignment with the discharge opening 50, the closure element 66 is in its first or uppermost position as shown in FIGS. 1, 3 and 5 such that the product flow passageway 48 is substantially sealed and the tendency for products remaining in the passageway 48 to dry and harden is substantially reduced. In addition, the rib 58, being now out of alignment with the slot 64, is in abutting relationship to the shoulder 62 such that accidental depression of the actuator 46 is prohibited.

When it is desired to dispense products, the user rotates ring 54 in a counterclockwise direction viewing FIG. 5 by grasping the serrated periphery of the ring 54 and turning the latter until the word "open" is in vertical alignment with the discharge opening 50 in the manner shown in FIG. 2. During such rotational movement of the ring 54, the rib section 68 of the closure element 66 rides along the helical groove 70 to cause the closure element 66 to shift downwardly along a path partially within a passage formed in the actuator 46 until reaching its second position. Rotation of the ring 54 in this fashion brings the vertical rib 58 of the ring 54 into alignment with the vertical slot 64, so that the rib 58 is provided with sufficient clearance to enable the actuator 46 (and the ring 54 therewith) to be depressed to pump products from the holding chamber 38.

Depression of the actuator 46 shifts the piston 42 downwardly and forces products within the chamber 38 through the product flow passageway 48 for exit through the discharge opening 50. The products during a depression stroke of the actuator 46 force the check valve 52 toward an open orientation to allow the products to flow from the chamber 38 to the passageway 48, and the pressure within the holding chamber 38 also urges the check valve 40 against the upper wall of housing 22 to prevent reverse flow of products back into the reservoir 26.

Once manual pressure on the actuator 46 is relieved, the spring 44 urges the piston 42, actuator 46 and locking ring 54 in an upwardly direction, with the resulting loss in pressure in the holding chamber 38 causing the check valve 52 to close while lifting the check valve segment 40 away from the upper wall of housing 22. As a consequence, the subatmospheric condition created in the chamber 38 during upward movement of the piston 42 draws a portion of the product within reservoir 26 through the upper opening and past the segment 40, and into the product holding chamber 38 in readiness for the next pumping operation. As the products are withdrawn from the reservoir 26, the lower piston 42 moves upwardly to take up the space in reservoir 26 previously occupied by the products.

A cap 72 is provided to cover the upper portions of the dispenser 20 when the latter is not in use. Preferably, cap 72 has inner depending, circular wall 74 (FIGS. 1 and 3) that comes into contact with an upper portion of the closure element 66 when the same is in its raised position covering the discharge opening 50. The wall 74 functions to prevent lateral or horizontal deflection of the closure element 66 so that the discharge opening 50 remains sealed when, for example, relatively large compressive forces are exerted on the housing 22 which might otherwise push products through the passageway 48 with sufficient force to deflect the closure element 66 and cause the products to leak from dispenser 20.

DETAILED DESCRIPTION OF THE EMBODIMENT SHOWN IN FIGS. 6–10

Figure 6:
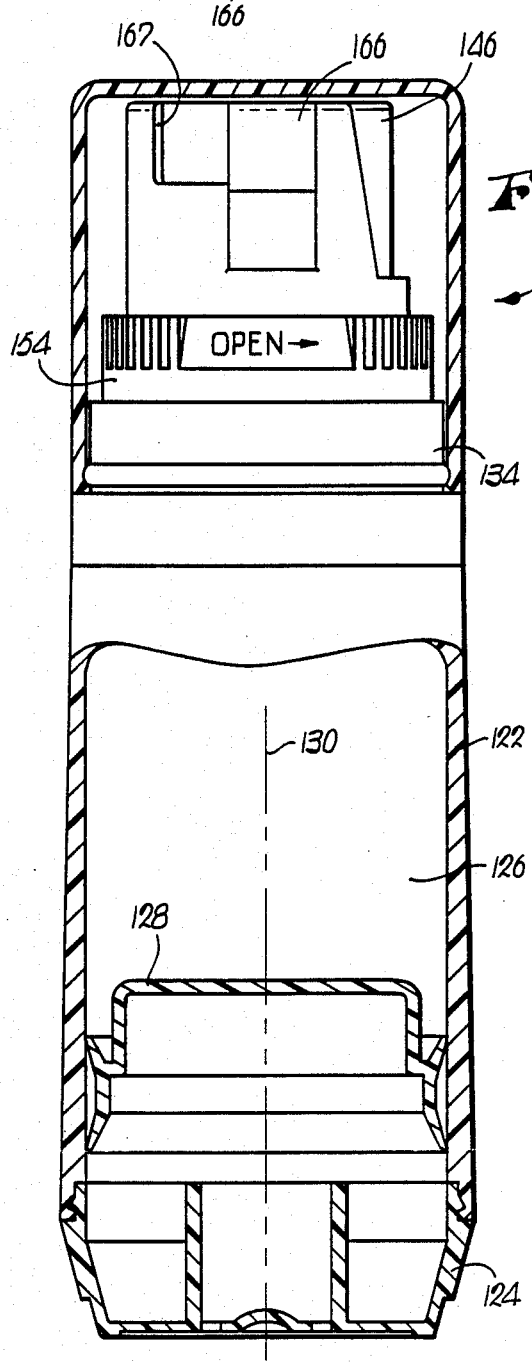
FIG. 6 is a side elevational view of a pump dispenser constructed in accordance with another preferred embodiment of our invention with portions cut away in section.

A pump dispenser 120 constructed in accordance with another preferred embodiment of our invention includes a main, generally cylindrical housing 122 that is covered at its lower end by a base 124 (FIG. 6). The housing 122 is tubular and presents a reservoir 126 for storage of products to be dispensed. A lower piston 128 is movable within the reservoir 126 along a vertical axis 130 (FIG. 6) when the dispenser 120 is an upright orientation as shown in the drawings.

A body 134 is coupled in snap-fit relation to an upper portion of the housing 122. The body 134 has interior cylindrical walls defining a product holding chamber 138 (FIGS. 9 and 10), the bottom of which includes an opening which is normally closed by a resilient check valve segment 140. When the segment 140 is opened, the product holding chamber 138 is in communication with the reservoir 126 formed within the housing 122.

Figure 8:
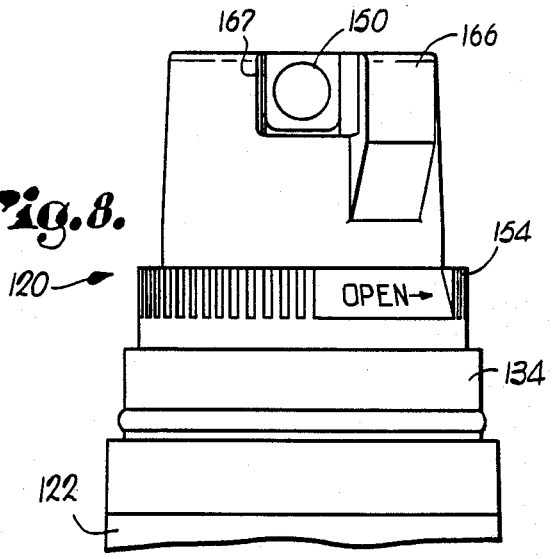
FIG. 8 is a fragmentary, side elevational view of an upper portion of the dispenser shown in FIG. 6 with the cap removed and with a locking ring rotated to shift a closure element toward a position away from a discharge opening.
Figure 10:
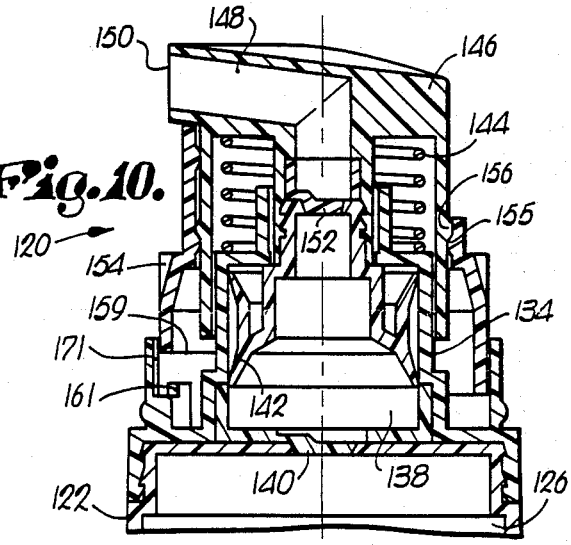
FIG. 10 is a view somewhat similar to FIG. 9 except that the locking ring has been rotated to shift the closure element away from the discharge opening and also enable depression of the actuator in order to pump products from a product holding chamber.

An upper piston 142 is slidably received within the product holding chamber 138 for reciprocable movement along axis 130. An upper, circular portion of piston 142 is fixed to a depending, inner section of a depressable acutator 146 by means of a snap interconnection established by ribs and grooves. The actuator 146 has internal structure defining a product flow passageway 148 which terminates in a discharge opening 150 (FIGS. 8 and 10).

A check valve 152 is captured in a recess formed within the actuator 146 above the top of the piston 142. The check valve 152 is inherently biased toward the closed position that is shown in FIGS. 9 and 10, but can be opened in the manner described below to communicate the chamber 138 with the passageway 148.

The actuator 146, along with the piston 142 connected thereto, is biased upwardly by means of a compression spring 144 which, in this embodiment, is received in an annular recess formed within the actuator 146 above the top of a flat shoulder of body 134.

An annular locking member or ring 154 is shiftably coupled to the actuator 146 and thereby to the body 134 by means of an inner, annular rib 155 that is captured beneath an outer rib or flange 156 formed in a lower portion of the actuator 146. The locking ring 154 along with the actuator 146 cannot normally become separated from remaining components of the dispenser 10 inasmuch as upward movement of the actuator 146 is limited by the piston 142, and upward movement of the latter is in turn limited as shown in FIGS. 9 and 10 by an inwardly extending, annular wall portion of the body 134 at the top of chamber 138. Although not depicted in the drawings, rotation of the actuator 146 relative to the body 134 is substantially precluded by upper, horizontal walls that extend through slots in the body 134 in a manner similar to the walls 60 as mentioned above in connection with the embodiment illustrated in FIGS. 1–5.

Figure 9:
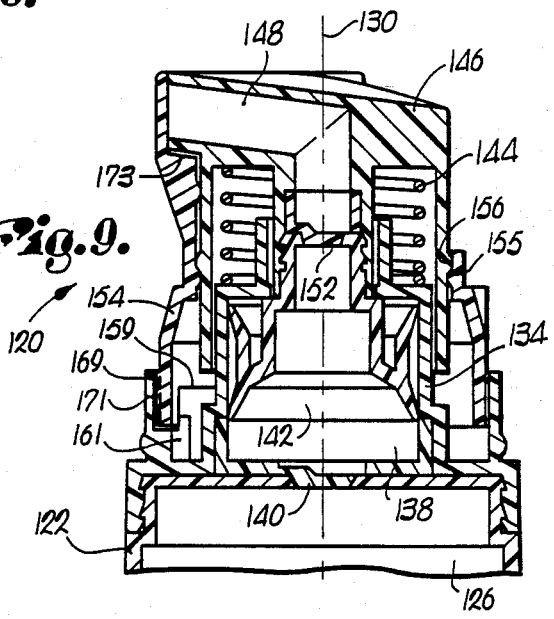
FIG. 9 is a fragmentary, side cross-sectional view of an upper portion of the dispenser shown in FIG. 6 with the cap removed and with the closure element in the closed position.

The locking ring 154 is rotatable about axis 130 between a first orientation which is shown in FIGS. 6, 7, and 9 and a second orientation that is shown in FIGS. 8 and 10. A lower, peripheral region of the locking ring 154 is cut away to present a relief 159 (FIGS. 9 and 10), while the body 134 is formed to integrally present an internal rib or stop 161 having an upwardly extending segment on one side thereof.

When the ring 154 is the first orientation as shown in FIGS. 6–7 and 9, the stop 161 is positioned directly beneath the lower end of ring 154 to one side of relief 159 such that the stop 161 precludes downward movement of the ring 154 as well as actuator 146 and piston 142. However, once the ring 154 is rotated toward its second orientation as shown in FIGS. 8 and 10, the relief 154 is in overlying relation to stop 161 and thereby permits depression of the actuator 146 simultaneously with downward movement of ring 154 and piston 142. The upwardly extending, side segment of the stop 161 prevents further clockwise rotation (viewing FIG. 7)

past the first orientation that is shown in FIGS. 6, 7 and 9.

The annular locking ring 154 is integrally formed to present a closure portion or element 166 (FIGS. 6–9) as well as a laterally adjacent, somewhat square orifice 167. Thus, when the ring 154 is in its first orientation as depicted in FIGS. 6–7 and 9, the closure element 166 is in a corresponding first position substantially closing the discharge opening 150. Rotation of the ring 154 toward its second orientation as illustrated in FIGS. 8 and 10 simultaneously moves the closure element 166 away from the discharge opening for uncovering the latter. In this embodiment, walls of the actutor 146 surrounding the discharge opening 150 protrude through the orifice 167 once the closure element 166 has been shifted toward its second position.

OPERATION OF THE EMBODIMENT SHOWN IN FIGS. 6–10

The locking ring 142 when in its closed or first orientation as depicted in FIGS. 6, 7 and 9 prohibits for all practical purposes the dispensing of products due to the fact that the lower end of the ring 154 is in directly abutting, overlying relation to the stop 161. At the same time, the closure element 166 covers the discharge opening 150 to substantially retard hardening of the products remaining within the passageway 148 as a result of previous use of the dispenser 20.

When it is desired to dispense products, the ring 154 is rotated to its second orientation wherein the relief 159 overlies stop 161 and thereby permits depression of the acutator 146 along with piston 142 coupled thereto. During such rotation, the closure element 166 moves away from the discharge opening 150 to uncover the latter so that the products can readily flow through the passageway 148 and out of the opening 150.

Pumping of products from the holding chamber 138 occurs in manner similar to the operation of the dispenser 20 described above with reference to FIGS. 1–5. In brief, downward movement of the piston 142 urges the check valve segment 140 toward its closed position which is shown in FIGS. 9 and 10, and causes portions of the products within holding chamber 138 to shift the upper check valve 152 toward an open orientation. Further downward movement of the piston 142 causes the products to flow through the passageway 148 and out of the discharge opening 150 for use. Once manual pressure on the actuator 146 is relieved, the spring 144 urges the actuator 146 upwardly toward the position shown in the drawings, thereby causing the upper check valve segment 152 to close while enabling the lower check valve 140 to open for withdrawal of another charge of products from the lower reservoir 126.

Advantageously, an elongated, upright rib 169 (FIG. 9) formed in a lower wall portion of the locking ring 154 rides in a complemental, upright groove 171 (FIG. 10) formed in the body 134 to provide some degree of resistance to unintentional rotation of the ring 154 as the actuator 146 is depressed. However, regions of the ring 154 adjacent rib 169 as well as corresponding regions adjacent the associated groove are readily deflectable in lateral directions during intentional rotation of the ring 154 so that the latter can be easily returned to its first orientation blocking downward movement of the actuator 146 as well as closing the discharge opening 150. In this regard, comparable structure is not provided for the embodiment shown in FIGS. 1–5 inasmuch as the shiftable, internal blade closure element 166 provides some degree of resistance to unintentional rotation of the ring 54.

When the ring 154 is in the position as shown in FIGS. 6, 7 and 9, a shoulder 173 (FIG. 9) directly underlies a lower spout portion of the actuator 146. The shoulder 173, in cooperation with the rib 155 and stop 161, prevents depression of the actuator 146 and thereby of the piston 142 in this orientation of the locking ring 154.

It can now be appreciated that in all embodiments of the invention the locking member or ring together with the shiftable closure element provide an especially effective means for either enabling or precluding dispensing of products while simultaneously uncovering or covering a discharge opening of the dispenser so that portions of the products adjacent the discharge opening do not quickly dry and harden. Further, the combination of the locking ring with the shiftable closure element allows the user, with a single rotation movement, to simultaneously unlock the actuator and uncover the discharge opening to permit full flow of products as the actuator is then subsequently depressed. This type of construction is well suited for smaller dispensers having limited pump strokes such as 0.1 inch with a corresponding ejection of 0.5 CC of products since the dispensers of this type are better adapted to be easily carried in purses or handbags where it is important that accidental discharge of the products be avoided.

It is understood that various modifications or additions to the embodiments currently preferred and described in detail may readily be effected without departing from the gist and essence of our contribution to the art. For example, although the components mentioned above are preferably constructed entirely of synthetic resin materials with the exception of the spring, use of other materials is also possible. Additionally, other types of check valves such as ball check valves could be substituted for the movable flap-type check valves shown in the drawings. Accordingly, the scope of the invention should be limited only by a fair reading of the claims which follow along with their mechanical equivalents thereof.

We claim:

1. In a product dispenser having a body with walls defining a product holding chamber and a piston reciprocably movable along a reference axis within said chamber for pumping products from the latter, the improvement comprising:

a depressible actuator connected to said piston for movement of the piston along said axis, said actuator including structure defining a passageway therethrough and in communication with said chamber for receiving the flow of products from said chamber upon movement of said piston, said structure terminating in a product discharge opening communicating with said passageway;

a closure element carried by said actuator and movable between a first position substantially closing the discharge opening and a second position away from said first position for enabling the flow of products through said opening; and a locking member rotatable relative to said actuator between a first orientation and a second orientation, said locking member being coupled to said closure element for moving said closure element toward said first position as said locking member is moved toward said first orientation and for moving said closure element toward said second position as said locking member is moved toward said second orientation, said locking member including means for preventing depression of said actuator and thereby movement of said piston when said locking member is in said first orientation and said closure element is in said first position substantially closing said discharge opening, said locking member being movable in an arc substantially about said axis of movement of said piston during movement between said first orientation and said second orientation.

2. The invention as set forth in claim 1, wherein said locking member has an annular configuration and generally surrounds said axis of piston movement.

3. The invention as set forth in claim 2, wherein said locking member is provided with a groove having a partially helical configuration, and wherein said closure element includes a portion received in said groove for movement of said element during pivotal movement of said locking member.

4. The invention as set forth in claim 1, wherein said locking member is integrally connected to said closure element.

5. The invention as set forth in claim 1, wherein said locking member is pivotal along an arc lying within a reference plane during movement between said first orientation and said second orientation, and wherein said locking member is movably coupled to said closure element.

6. The invention as set forth in claim 5, wherein said closure element moves along a path generally perpendicular to said reference plane during movement between said first position and said second position.

7. The invention as set forth in claim 1, wherein said piston is movable along an axis, and wherein said locking member is pivotal along an arc about said axis.

8. The invention as set forth in claim 1, wherein said closure element is movable along a path at least partially within said actuator during movement of said element toward said second position.

9. The invention as set forth in claim 1, wherein said closure element is movable along a path at least partially within said actuator during movement of said element toward said second position.

10. The invention as set forth in claim 1, wherein said actuator has a top finger engaging portion for depressing of the actuator, and wherein said locking member is spaced below said finger engaging portion.

* * * * *